US007694728B2

(12) United States Patent
Nakamura

(10) Patent No.: US 7,694,728 B2
(45) Date of Patent: Apr. 13, 2010

(54) HEAT EXCHANGER

(75) Inventor: Yoichi Nakamura, Nagoya (JP)

(73) Assignee: T. Rad Co., Ltd., Tokyo (JP)

( * ) Notice: Subject to any disclaimer, the term of this patent is extended or adjusted under 35 U.S.C. 154(b) by 177 days.

(21) Appl. No.: 11/664,191

(22) PCT Filed: Sep. 27, 2005

(86) PCT No.: PCT/JP2005/018259

§ 371 (c)(1),
(2), (4) Date: Mar. 28, 2007

(87) PCT Pub. No.: WO2006/035987

PCT Pub. Date: Apr. 6, 2006

(65) Prior Publication Data

US 2008/0135221 A1 Jun. 12, 2008

(30) Foreign Application Priority Data

Sep. 28, 2004 (JP) ..... 2004-281862

(51) Int. Cl.
*F28D 7/10* (2006.01)
*F28F 9/02* (2006.01)

(52) U.S. Cl. ..... 165/157; 165/173

(58) Field of Classification Search ..... 165/157, 165/158, 164–166, 173
See application file for complete search history.

(56) References Cited

U.S. PATENT DOCUMENTS 2,019,351 A * 10/1935 Lathrop ..... 165/165
3,734,177 A * 5/1973 Bellovary et al. ..... 165/166
4,473,111 A 9/1984 Steeb
5,111,671 A 5/1992 Kadle
5,282,507 A * 2/1994 Tongu et al. ..... 165/165
5,720,341 A 2/1998 Watanabe et al.
6,016,865 A 1/2000 Blomgren
6,059,023 A * 5/2000 Kurematsu ..... 165/165
6,102,111 A 8/2000 Kamio et al.

(Continued)

FOREIGN PATENT DOCUMENTS

EP 0 942 156 9/1999

(Continued)

*Primary Examiner*—Tho V Duong
(74) *Attorney, Agent, or Firm*—Jordan and Hamburg LLP

(57) ABSTRACT

In a heat exchanger in which the number of parts is small, assembling is easy, bonded portions of each part are fewer and reliability of brazing is improved, a core body is constituted by turning up and bending a strip-shaped metal plate in a fanfold manner, and first flow passages and second flow passages are formed alternately in the thickness direction. Both ends of each of the first flow passages are blocked by each come tooth of a pair of comb-state members, and a fin is set within the second flow passages so as to constitute a core. And in the heat exchanger in which a cylindrical casing is fitted with the outer periphery of the core body, the comb-state member has its tooth base crossing perpendicularly with each of the comb tooth and a root of each comb tooth bent in the L-shape along the tooth base, the plane of the tooth base is brought into contact with a turned-up end edge, and each connection portion between the comb-state member and the core body is integrally brazed/fixed.

4 Claims, 10 Drawing Sheets

U.S. PATENT DOCUMENTS

| | | | | |
|---|---|---|---|---|
| 6,141,961 | A | 11/2000 | Rinckel | |
| 6,269,870 | B1 * | 8/2001 | Banzhaf et al. | 165/158 |
| 6,293,337 | B1 * | 9/2001 | Strahle et al. | 165/166 |
| 6,321,835 | B1 | 11/2001 | Damsohn et al. | |
| 6,408,941 | B1 * | 6/2002 | Zuo | 165/165 |
| 6,807,955 | B2 | 10/2004 | Leedham et al. | |
| 6,898,930 | B2 | 5/2005 | Nakatani et al. | |
| 6,976,480 | B2 | 12/2005 | Miyoshi et al. | |
| 6,997,250 | B2 * | 2/2006 | Dilley et al. | 165/174 |
| 7,032,577 | B2 | 4/2006 | Rosin et al. | |
| 7,077,190 | B2 | 7/2006 | Hayashi et al. | |
| 7,159,649 | B2 * | 1/2007 | Thyrum et al. | 165/165 |
| 7,168,419 | B2 | 1/2007 | Rosin et al. | |
| 7,204,302 | B2 | 4/2007 | Shibagaki et al. | |
| 7,284,599 | B2 * | 10/2007 | Karoliussen | 165/165 |
| 7,287,579 | B2 | 10/2007 | Dilley et al. | |
| 7,311,090 | B2 | 12/2007 | Lyons | |
| 7,438,062 | B2 | 10/2008 | Okawa et al. | |
| 2005/0121173 | A1 | 6/2005 | Inagaki et al. | |
| 2006/0048926 | A1 * | 3/2006 | Richter | 165/165 |
| 2007/0289318 | A1 | 12/2007 | Nakamura | |
| 2008/0087409 | A1 | 4/2008 | Nakamura | |
| 2009/0194265 | A1 | 8/2009 | Nakamura | |

FOREIGN PATENT DOCUMENTS

| | | |
|---|---|---|
| EP | 1 164 280 | 12/2001 |
| EP | 1363012 | 11/2003 |
| EP | 1555421 | 7/2005 |
| EP | 1630403 | 3/2006 |
| EP | 1746263 | 1/2007 |
| JP | 60-147097 | 8/1985 |
| JP | 60-150468 | 8/1985 |
| JP | 63-088212 | 4/1988 |
| JP | 5-018634 | 1/1993 |
| JP | 10-122768 | 5/1998 |
| JP | 2001-141388 | 5/2001 |
| JP | 2002-318095 | 10/2002 |
| JP | 2004-257366 | 9/2004 |
| JP | 2004-278351 | 10/2004 |
| WO | WO- 02/10574 | 2/2002 |
| WO | WO- 2004/065876 | 8/2004 |

* cited by examiner

HEAT EXCHANGER

BACKGROUND OF THE INVENTION

The present invention relates to a heat exchanger in a simple structure which can be applied to a heat exchanger (EGR cooler) used in an exhaust gas recirculation apparatus in an automobile and other heat exchangers, in which a core body formed by bending a strip-shaped metal plate in a fanfold manner, and having flat first flow passages and second flow passages alternately in the thickness direction of the metal plate, each of the first flow passages of the core body being blocked by each tooth of a pair of comb-state members at both end positions.

A conventional EGR cooler is made of an assembly of a large number of flat tubes or a large number of plates, a large number of fins, a casing and a header, in which cooling water is made to communicate through the casing side and an exhaust gas is made to communicate inside each of the flat tubes or the like as proposed in the invention described in Japanese Patent Application Laid-Open No. 5-18634.

Another heat exchanger is proposed in which a core of the heat exchanger is formed by a strip-shaped metal plate bent in a fanfold manner and a pair of comb-state members, the outer periphery being fitted with a cylindrical casing, and a pair of headers are provided at openings on both ends in the longitudinal direction and ports for cooling water at both ends of the casing in the longitudinal direction as in the invention described in WO 2004/065876 A1.

In the former heat exchanger such as the EGR cooler, the number of parts is large, which makes assembling cumbersome and increases the number of brazing portions on the parts, and there is a problem that a leakage tends to occur at the brazing portion.

In the latter heat exchanger, comb teeth of the comb-state member are arranged at every other of the large number of flat groove-state portions in a core body formed in the fanfold state, and the groove bottom and the tip end of the comb tooth are bonded. And the casing is fitted with the outer periphery of the core. In this type of heat exchanger, there is a problem that a gap tends to occur at a brazed portion between the root of each comb tooth and the side face of the core body as well as between the tip end of each comb tooth and each groove bottom, from which leakage of a fluid easily occurs. Along with that, a crack is easily generated at a brazed portion particularly at the root portion of each comb tooth by a heat stress or the like due to use of the heat exchanger.

The present invention has an object to provide a heat exchanger in which the number of parts is small, assembling is easy, leakage does not occur, and reliability in a brazed portion is high.

SUMMARY OF THE INVENTION

The present invention in accordance with a first aspect thereof is a heat exchanger comprising a core body (5) in which a strip-shaped metal plate is turned up and bent in a fanfold manner with turned-up end edges (1), (2) alternately formed at one end and the other end of a rectangular flat face portion (1*a*), and flat first flow passages (3) and second flow passages (4) are provided alternately in the thickness direction of the metal plate, each of the first flow passages (3) of the core body (5) being blocked by each comb tooth (6*b*) of a pair of comb-state members (6) at both end positions of the turned-up end edge (1), and a fin (7) being set between the second flow passages (4) so as to constitute a core (8), the outer periphery of the core body (5) being fitted with a cylindrical casing (9) so as to block the adjacent turned-up end edges (1), (2), a first fluid (10) being guided to each of the first flow passages (3) by a pair of inlet/outlet ports (11) on the outer face of the casing (9), while a second fluid (12) being guided from one of cylindrical openings (13) of the casing (9) to the other opening (13) through each of the second flow passages (4), wherein in each of the comb-state members (6), its tooth base (6*c*) crosses perpendicularly with each of the comb teeth (6*b*), a root (14) of each comb tooth (6*b*) is bent in the L-shape along the tooth base (6*c*), a plane of the tooth base (6*c*) is in contact with the turned-up end edge (2), and each connection portion between the comb-state member (6) and the core body (5) is integrally brazed/fixed.

The present invention in accordance with a second aspect thereof is the heat exchanger in accordance with the first aspect thereof, wherein a tip end portion of each comb tooth (6*b*) of one of the comb-state members (6) has a curved portion (24), the end of the curved portion (24) is formed so as to face the other comb-state member (6), and the first fluid (10) is guided from the vicinity of the tooth base (6*c*) of the one comb-state member (6) to each of the first flow passages (3).

The present invention in accordance with a third aspect thereof is the heat exchanger in accordance with the second aspect thereof, wherein the tip end of the curved portion (24) is turned up, where a turned-up tip end portion (24*a*) is formed, and the turned-up tip end portion (24*a*) is brought into contact with/fixed to the turned-up end edge (1) of the core body (5).

The heat exchanger of the present invention is constructed as above and has the following effects.

In the heat exchanger of the present invention in which the core 8 is comprised by the core body 5 formed by bending a strip-shaped metal plate in a fanfold manner, the comb-state member 6 and the fin 7, the outer periphery of the core 8 is fitted with the casing 9, the tooth base 6*c* and the comb tooth 6*b* are crossed perpendicularly with each other as the comb-state member 6, the root 14 of the comb tooth 6*b* is bent in the L-shape along the tooth base 6*c*, the plane of the tooth base 6*c* is brought into contact with the turned-up end edge 2, and each contact portion between the comb-state member 6 and the core body 5 is integrally brazed/fixed. Thus, the brazing strength at the root portion of each comb tooth where a crack tends to occur particularly easily is increased, generation of a crack at the brazed portion by heat stress or the like can be prevented, and leakage is hard to occur. Along with that, a gap between the core body 5 and the tooth base 6*c* can be fully blocked so as to eliminate the gap. By this, leakage of the fluid is eliminated and reliability of brazing can be improved.

Next, if the curved portion 24 is formed at the tip end portion of at least one of the comb-state members 6, the first fluid 10 can be distributed smoothly in the first flow passage 3, a remained portion of the first fluid 10 can be eliminated so as to prevent local boiling by partial heating, and heat exchange performance can be improved. Along with that, an elasticity is generated at the curved portion 24 at the tip end portion of each comb tooth 6*b*, the tip end is elastically brought into contact with each groove bottom 3*a* of the core body 5 in the core assembled state so that the gap between a groove bottom 3*a* and the comb tooth 6*b* is eliminated and fully blocked, and reliability of brazing is improved.

Also, when the tip end of the curved portion 24 is turned up so as to form the turned-up tip end portion 24*a* and that is brought into contact with/fixed to the turned-up end edge 1 of the core body 5, reliability of brazing can be improved and reinforced. Along with that, the elasticity is further generated at the curved portion 24, and the tip end is further elastically brought into contact with each groove bottom 3*a* of the core body 5 in the core assembled state so that a contact area is widened, brazing strength is increased and a gap between the groove bottom 3*a* and the comb tooth 6*b* is eliminated and fully blocked so as to further improve brazing reliability.

DETAILED DESCRIPTION OF THE INVENTION

Next, embodiments of the present invention will be described based on the attached drawings.

Figure 1:
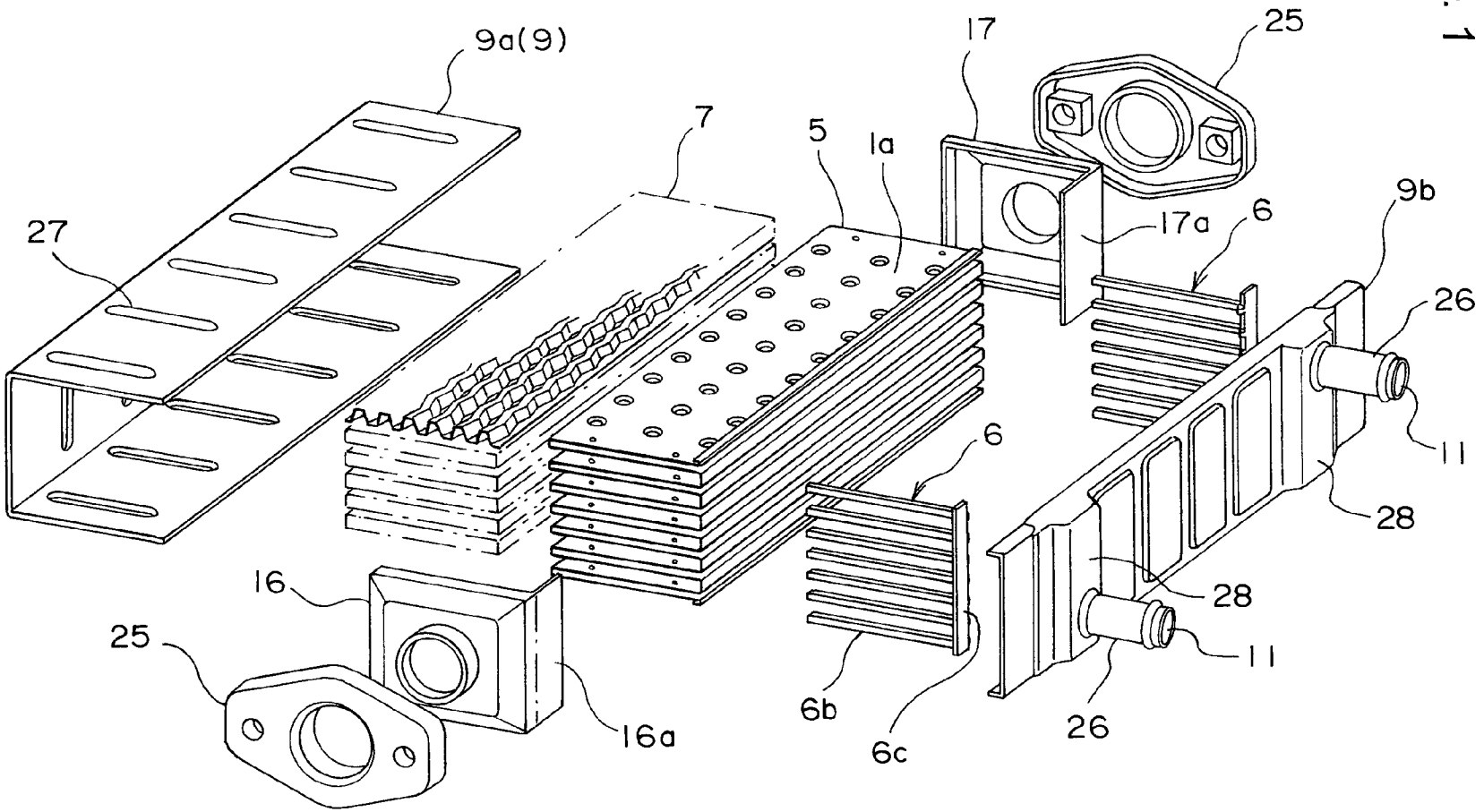
FIG. 1 is an exploded perspective view of a heat exchanger of the present invention.
Figure 2:
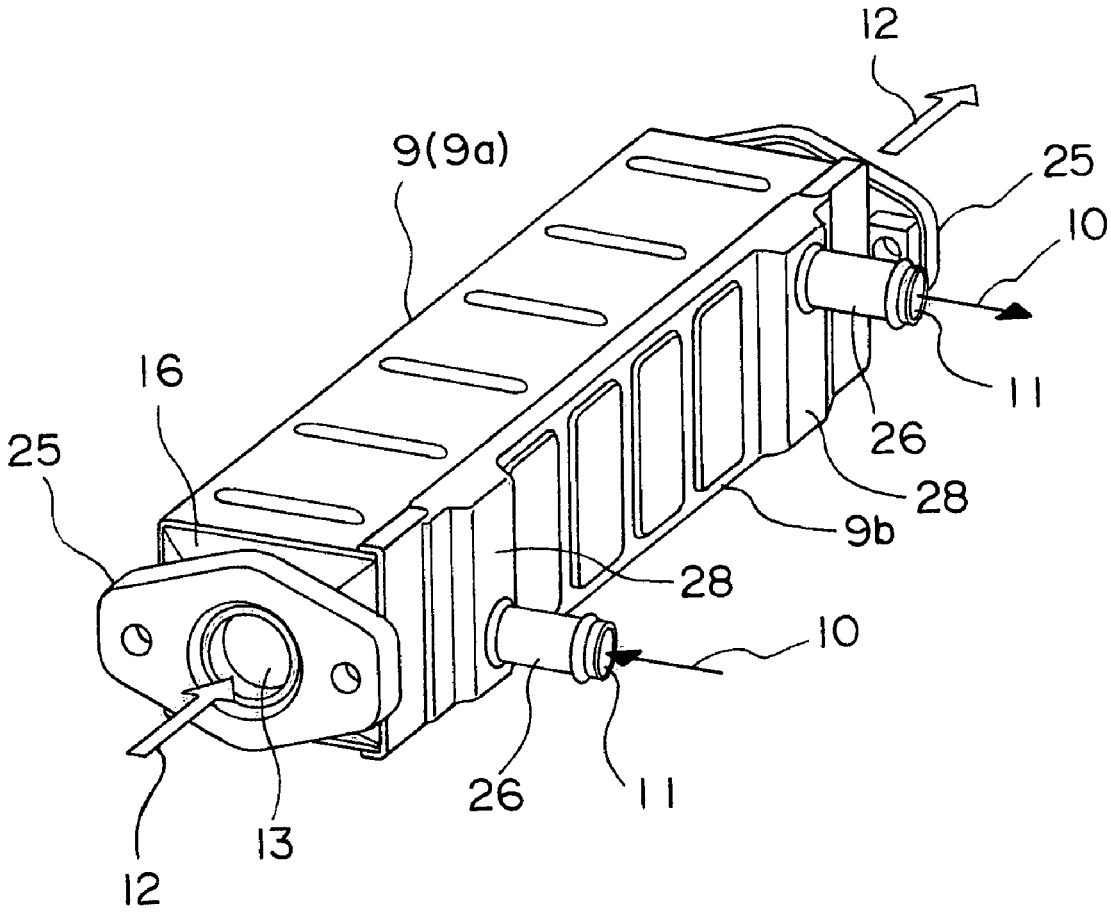
FIG. 2 is a perspective view illustrating an assembled state of the heat exchanger.
Figure 3:
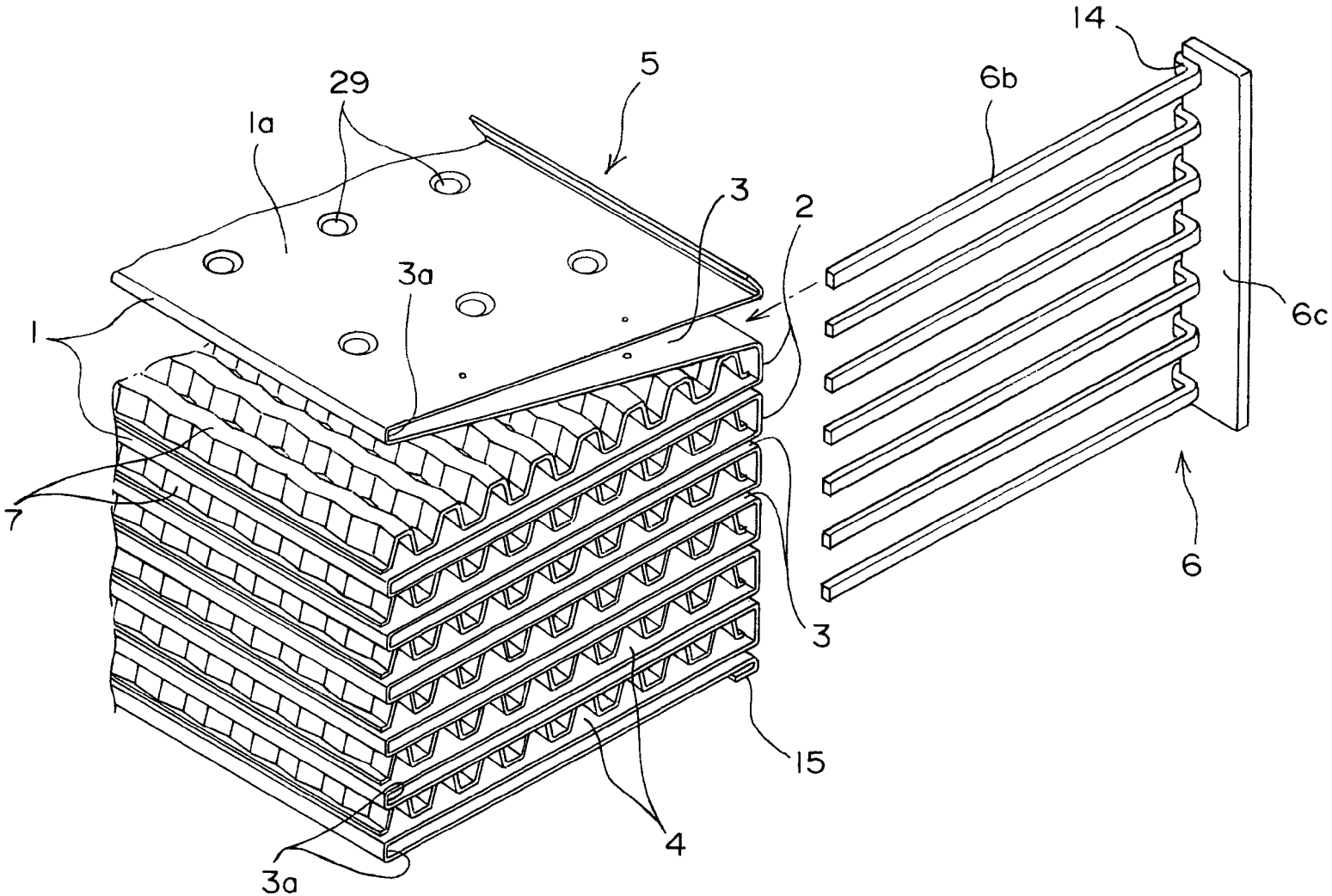
FIG. 3 is an explanatory view of an assembly of a core body 5 and a comb-state member 6 of the heat exchanger.
Figure 4:
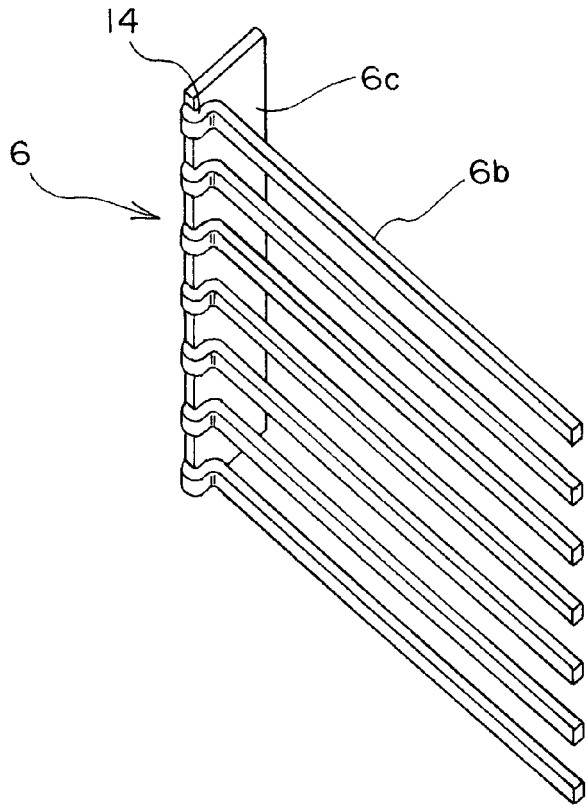
FIG. 4 is a perspective view of the comb-state member 6.
Figure 5:
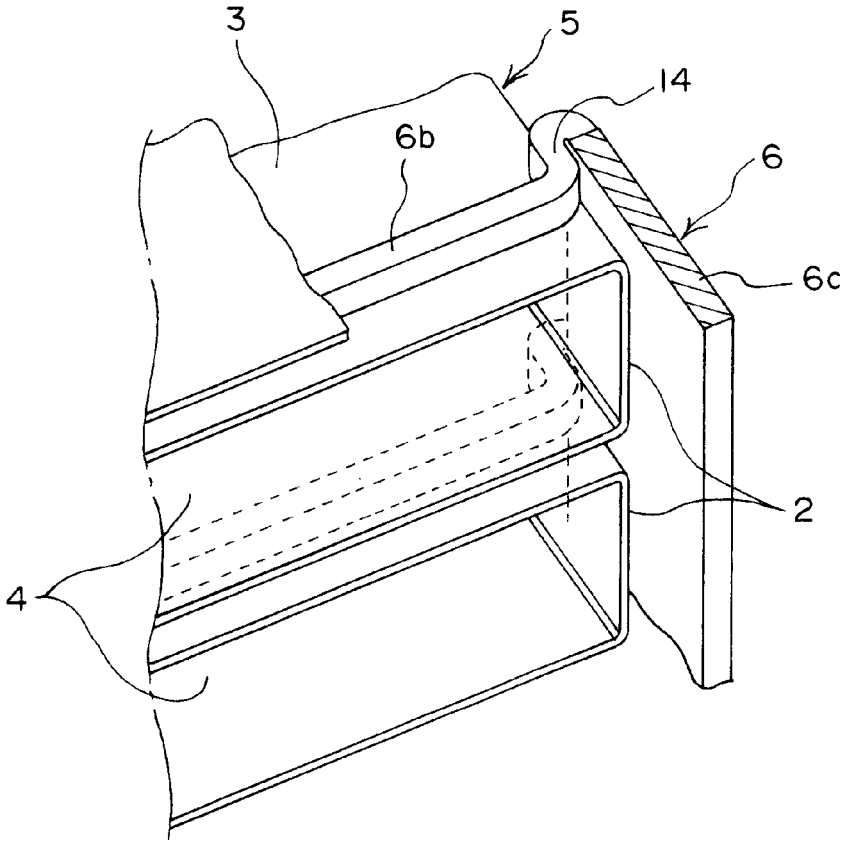
FIG. 5 is an enlarged perspective view of essential parts illustrating a state where the comb-state member 6 is inserted into the core body 5.
Figure 6:
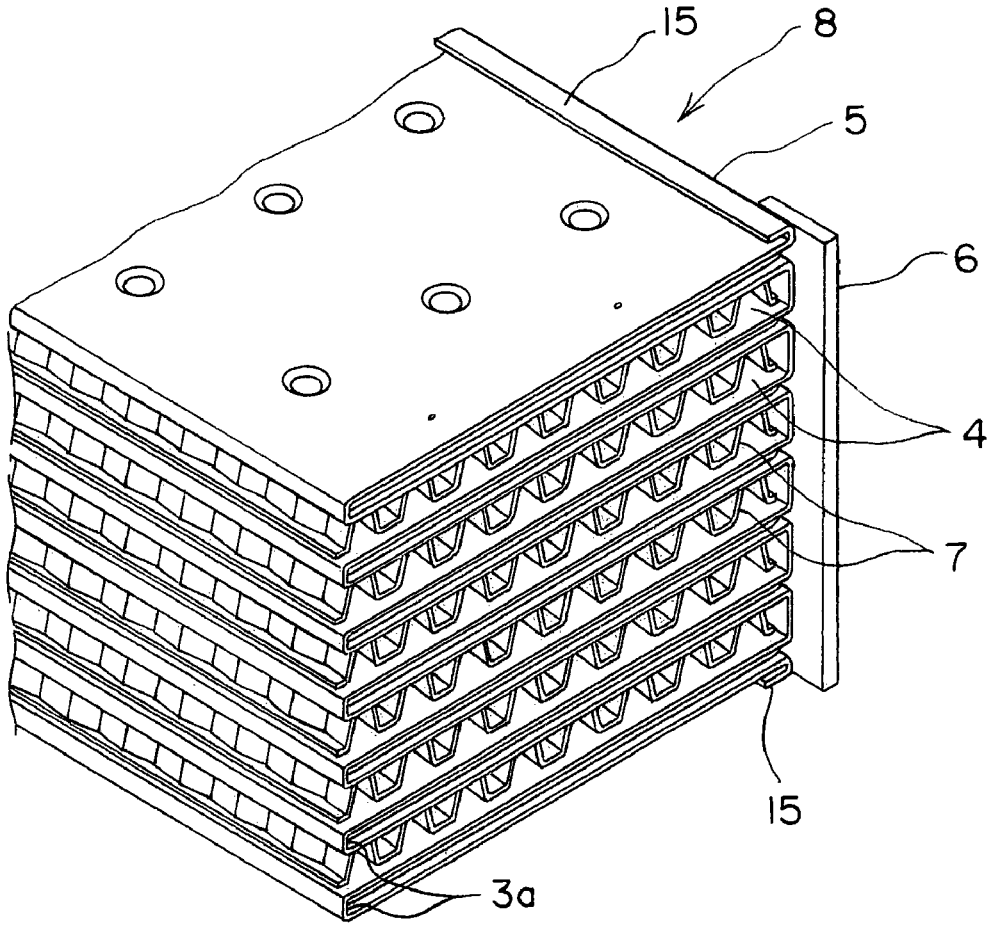
FIG. 6 is a perspective view illustrating an assembled state of the comb-state member 6 and the core body 5.

FIG. 1 is an exploded perspective view of a heat exchanger of the present invention, FIG. 2 shows its assembled state and FIG. 3 is an explanatory view of an assembly of a core body 5 and a comb-state member 6. Also, FIG. 4 is a perspective view of the comb-state member, FIG. 5 is a partially cutaway enlarged perspective view illustrating the assembled state, and FIG. 6 is a perspective view of the assembled state.

Figure 9:
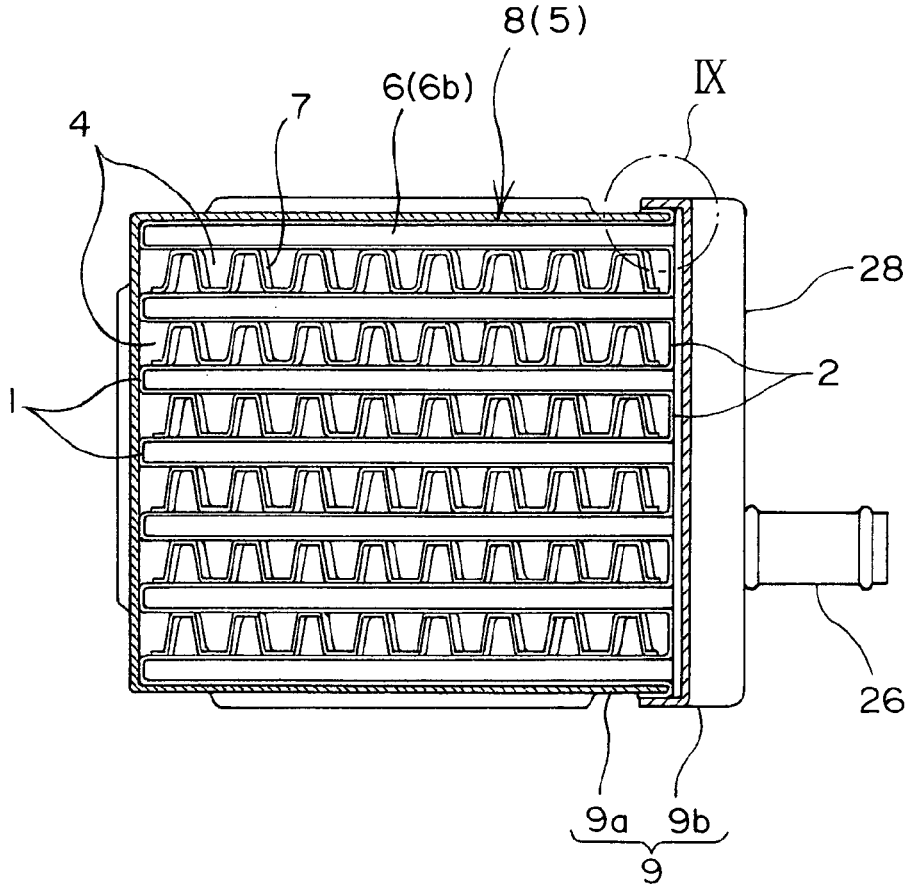
FIG. 9 is a cross sectional view of the heat exchanger of the present invention.
Figure 10:
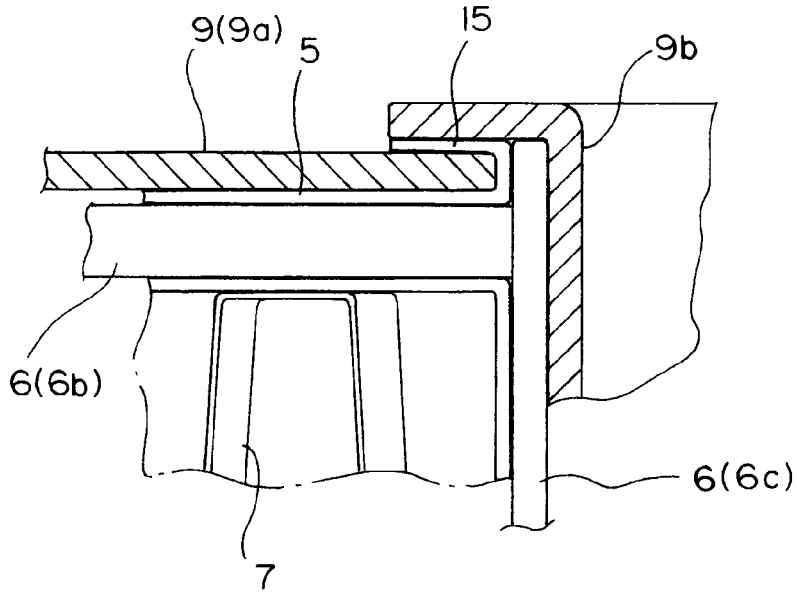
FIG. 10 is an enlarged view of IX part of FIG. 9.

Moreover, FIG. 9 is a cross sectional view of the heat exchanger and FIG. 10 is an enlarged view of IX part of FIG. 9.

This heat exchanger has a core body 5, a large number of fins 7, a casing 9, a pair of headers 16, 17, and the pair of comb-state members 6.

The core body 5 is formed by turning up and bending a strip-shaped metal plate in a fanfold manner as shown in FIG. 3 so that turned-up end edges 1, 2 are formed alternately at one end and the other end of a rectangular flat face portion 1*a*, and flat first flow passages 3 and second flow passages 4 are provided alternately in the thickness direction of the metal plate. In this example, a space of the first flow passage 3 is formed smaller than that of the second flow passage 4. It is needless to say that the spaces of the both can be the same or vice versa.

A large number of dimples 29 are formed on the first flow passage 3 side of the strip-shaped metal plate. In this example, the opposing dimples 29 are brought into contact with each other at their tip ends so as to hold the space of the first flow passage 3 constant. To each of the first flow passages 3, each comb tooth 6*b* of the comb-state member 6 is fitted at the both end positions of the turned-up end edges 1, and the fitted portions are integrally brazed/fixed. Also, instead of the dimples, an inner fin may be inserted into the first flow passage 3 and the inner face and both sides in the thickness direction of the inner fin may be brazed/fixed together.

In the comb-state member 6, a tooth base 6*c* is provided at a right angle with a come tooth 6*b*, and a root 14 of the comb tooth 6*b* is bent in the L-shape along the comb base 6*c* (FIGS. 4, 5).

The comb-state member 6 constructed as above, as shown in FIG. 5, has its tooth base 6*c* in contact with the end face of the turned-up end edge 2, and the root 14 is in contact with the corner part so that a brazed area of each contact portion is large. By this, brazing strength of the root 14 is increased, and reliability of brazing is improved. Also, the tip end of each comb tooth 6*b* is brought into contact with the groove bottom 3*a* of each of the first flow passages 3 (FIG. 7).

The root 14 and the tooth base 6*c* are manufactured in contact or with an extremely slight gap.

Next, the fins 7 are set between each of the second flow passages 4 as shown in FIG. 3. Though the first flow passage 3 at the uppermost position is shown in the lifted state in FIG. 3 so that the fin 7 is easy to be seen, the lower face side of the first flow passage 3 at the uppermost position is actually in contact with the fin 7 on the uppermost stage as shown in FIG. 6. This fin 7 is formed by bending a metal plate in the wave-form in the cross sectional direction and also in the longitudinal direction of its ridge line and trough portion so as to improve agitating effect of a fluid communicating through the second flow passage 4.

A core 8 in FIG. 6 is constituted by an assembly of the core body 5, the comb-state member 6 and the fin 7 as above. Instead of the above fin 7, a slit fin, an offset fin or a louver fin, not shown, may be inserted into the second flow passage 4.

Next, the casing 9 fitted over the outer periphery of this core 8 is formed in the cylindrical shape with a rectangular section longer than the length of the core 8 and has a pair of header portions 31 (See FIGS. 12, 13) outside the both ends of the core 8. This casing 9 is comprised by a channel-state member 9*a* and a lid member 9*b* in this embodiment as shown in FIGS. 1 and 9.

The channel-state member 9*a* has its inner circumferential face in contact with both the upper and lower faces and one side of the core body 5 so as to block between the adjacent turned-up end edges 1 of the core body 5. The lid member 9*b* blocks the opening side of the channel-state member 9*a*, blocks the other side of the core body 5 and blocks between the adjacent turned-up end edges 2. The channel-state member 9*a* is made of high heat-resistant/corrosion-resistant nickel steel, stainless steel or the like and prevents damage from a high-temperature exhaust gas as a second fluid 12 communicating through the inner surface. On the other hand, since cooling water as a first fluid 10 communicates through the inner surface of the lid member 9*b*, it may have poorer heat resistance or corrosion resistance than those of the channel-state member 9*a*. In general, stainless steel plate with poorer heat resistance or corrosion resistance has better forming performance than that of the high heat-resistant/corrosion-resistant material and is inexpensive. In this embodiment, the lid member 9*b* is formed with a pair of small tank portions 28 projected by press work on the outer face side at the both end positions as shown in FIG. 1, in which inlet/outlet ports 11 are opened, respectively, and pipes 26 are connected to the ports 11. By using a stainless steel plate with poor heat resistance/corrosion resistance to some degree, processing of this small tank portion 28 is facilitated.

Figure 11:
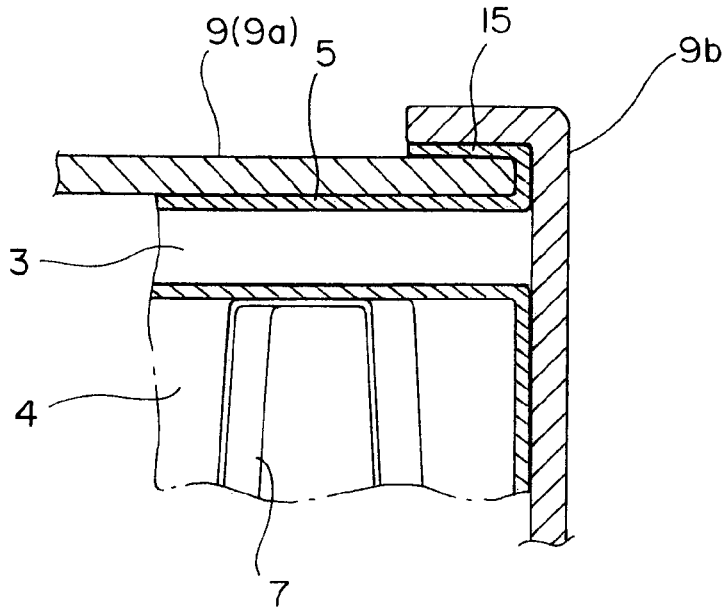
FIG. 11 is the same enlarged view of an intermediate portion of the core in the longitudinal direction.

The tip end edges of the both side walls of the channel-state member 9*a* are fitted to fitting edge portion 15 (FIGS. 6, 9, 10) turned up and formed at both upper and lower ends of the core body 5. FIG. 11 is a cross sectional view at the intermediate part of the core in the longitudinal direction. The L-shaped portions of both upper and lower ends of the lid member 9*b* are fitted over the outer face side of the fitting edge portion 15.

By this, brazing reliability at each connection portion between the lid member 9*b* and the channel-state member 9*a* and the core body 5 can be improved.

Figure 13:
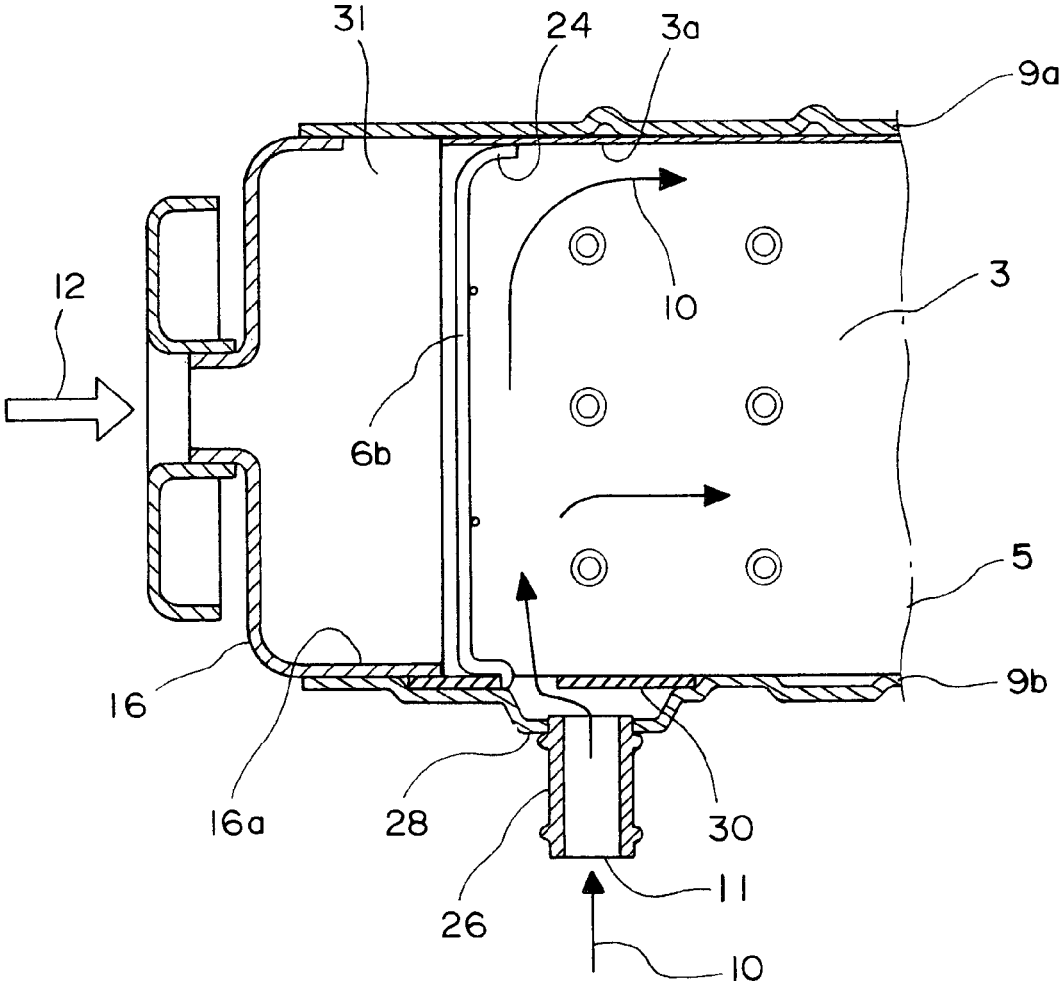
FIG. 13 is a plan view of a longitudinal section of the heat exchanger.

Next, opening ends of the header portions 31 of the both ends of the casing 9 in the longitudinal direction are blocked by a pair of header end lids 16, 17 made of a high heat-resistant/corrosion-resistant material, and a flange 25 is fitted to the outside. The header end lids 16, 17 are swollen outward in the pot shape in this embodiment, and an inlet/outlet port for the second fluid 12 is opened at the center. Moreover, on one side of each of the header end lids 16, 17, extension portions 16*a*, 17*a* are integrally extended and the extension portions 16*a*, 17*a* cover the inner surfaces of the both ends of the lid member 9*b* as shown in FIG. 13.

A brazing material covers or is arranged at each connection portion of this heat exchanger, and the whole in the assembled state shown in FIG. 2 is integrally brazed/fixed in a high-temperature furnace.

As shown in FIG. 7, the first fluid 10 is supplied to the first flow passage 3 side, while the second fluid 12 is supplied to the second flow passage 4 side. As an example, the first fluid 10 made of cooling water is supplied to each of the first flow passages 3 through one of the pipes 26 and the small tank portions 28 projected on one side of the casing 9 and it communicates in the longitudinal direction and flows out of the other pipe 26. Also, as an example, the second fluid 12 made of a high-temperature exhaust gas is supplied to each of the second flow passages 4 from the opening of the header end lid 16 through an opening 13 of the casing 9.

A pair of comb-state members 6 (FIG. 1) constitute header plates.

Figure 7A:
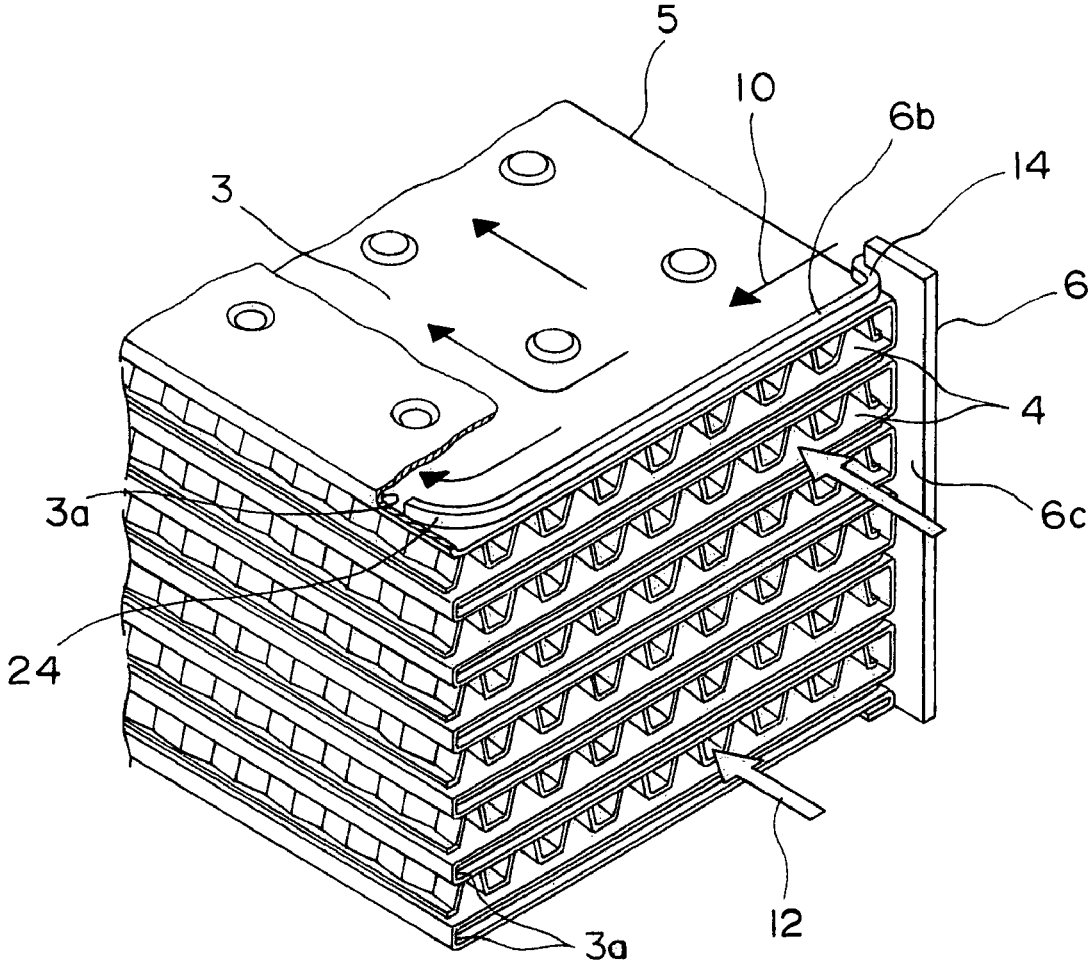
FIG. 7 is an explanatory view illustrating another example of the comb teeth 6*b* of the comb-state member 6.
Figure 7B:
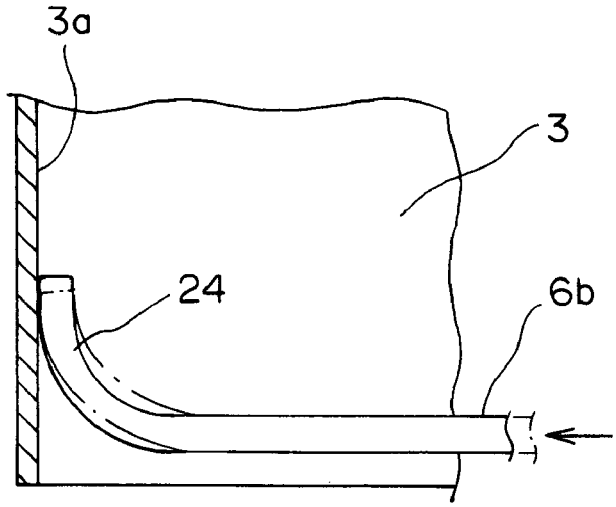

This comb-state member 6 can have its tip end portion formed in a curved portion 24 as shown in FIG. 7A, and in this case, the flow of the first fluid 10 can be smoothly guided in the longitudinal direction at the end of the comb-state member 6. By this, a remained portion of the first fluid 10 can be eliminated, and if the first fluid 10 is cooling water, boiling at that part can be prevented, and heat exchange can be promoted.

The core is assembled in the state where the tip end of this curved portion 24 is in elastic contact with the groove bottom 3*a* of the first flow passage 3. That is, the outer periphery of the core body is compressed by an assembling jig in a direction that the tip end portion of each comb tooth 6*b* is brought into contact with the groove bottom 3*a* from the state shown by a chained line to the state shown by a solid line in FIG. 7B. If the curved portion 24 exists at the tip end portion, elasticity is generated there, and the tip end is elastically brought into contact with each groove bottom 3*a* of the core body 5 in the core assembled state, and a gap between the groove bottom 3*a* and the comb tooth 6*b* is eliminated and fully blocked, which enables brazing without a gap in the subsequent brazing process and improves reliability.

Figure 8:
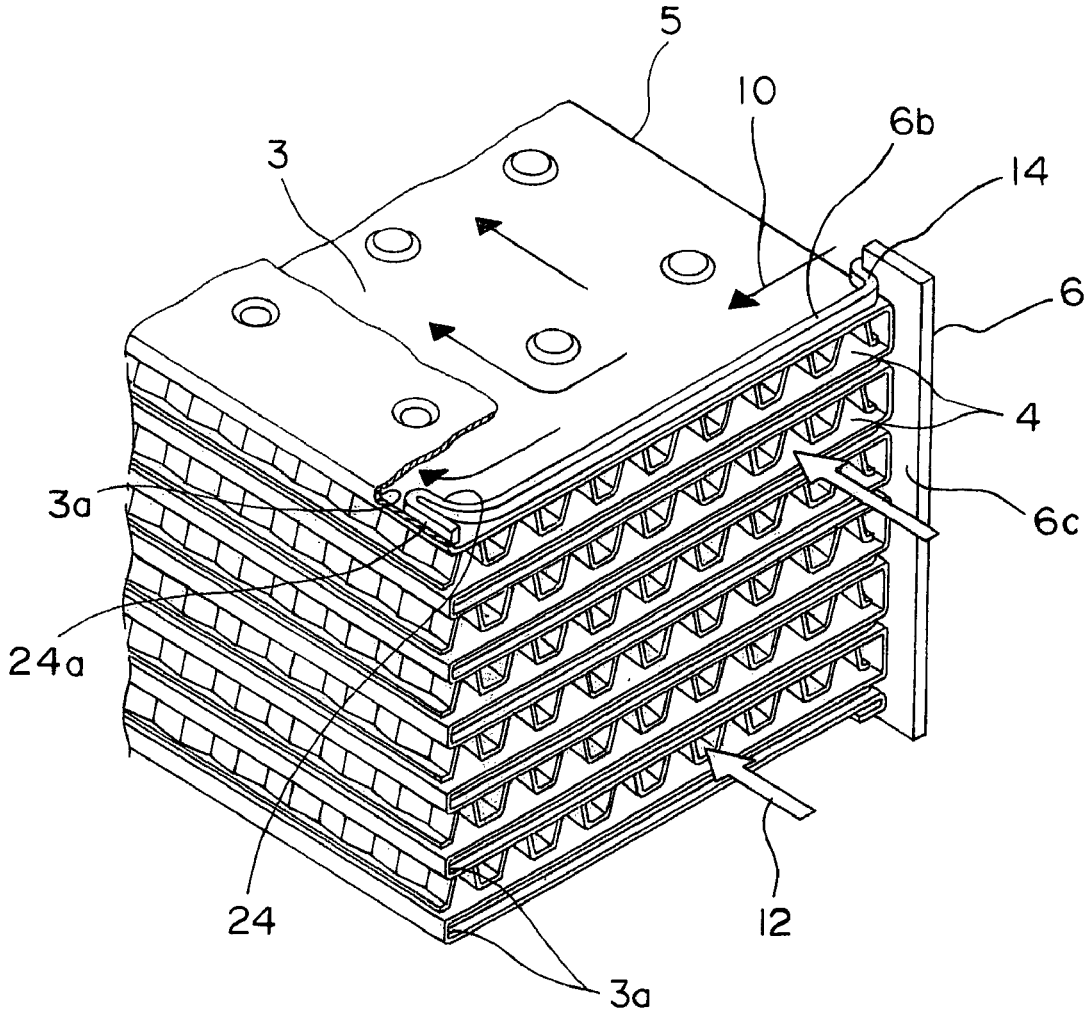
FIG. 8 is an explanatory view illustrating still another example of the comb teeth 6*b* of the comb-state member 6.

Next, FIG. 8 is a variation of FIG. 7, in which the tip end of the curved portion 24 is turned up so as to construct a turned-up tip end portion 24*a*. And the turned-up tip end portion 24*a* is brought into contact with/fixed to the inner surface of the turned-up end edge 1 of the first flow passage 3. In this case, elasticity is also generated at the tip end portion, which enables full blocking and improves brazing reliability.

Figure 12:
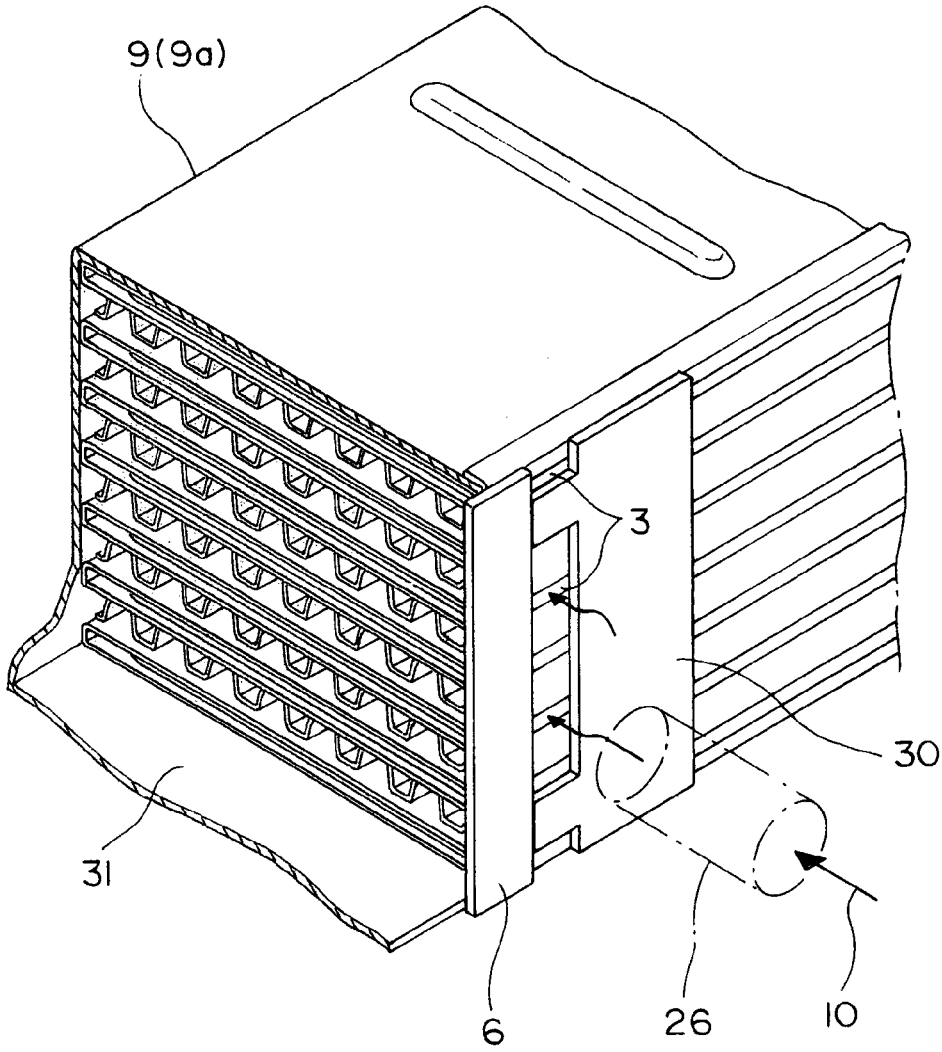
FIG. 12 is a perspective explanatory view illustrating a buffer plate employed for the heat exchanger of the present invention.

Next, FIGS. 12, 13 illustrate a state where a buffer plate 30 is provided at the inlet side of the first fluid 10 so as to enable even distribution of the cooling water in each part of the first flow passages 3. In the embodiment of FIG. 2, since a pair of small tank portions 28 exist at the both ends of the lid member 9*b*, the first fluid 10 flowing from the pipe 26 tends to flow more on the lid member 9*b* side when communicating through each of the first flow passages 3. Consequently, the buffer plate 30 is opposed to the opposite face on the outlet side of the cooling water of the pipe 26, and an opening is formed in the slit state only on the left side so that the flow velocity of the first fluid 10 flowing out of the opening is increased. The first fluid 10 is guided by the motion energy to a position separate from the lid member 9*b*. That is, the first fluid 10 bypasses the buffer plate 30 and flows out to the first flow passage 3 in a squeezed state as shown by an arrow. At this time, a part of the first fluid 10 is guided to the left in the figure along the L-shaped portion at the root of the comb tooth 6*b* and is guided smoothly in the width direction of the flow passage along the straight portion of the comb tooth 6*b*. Therefore, the L-shaped bent portion at the root of the comb tooth 6*b* has an effect to reduce fluid resistance in the vicinity of the inlet (as well as outlet) portion of the first fluid 10.

The invention claimed is:

1. A heat exchanger comprising a core body in which a strip-shaped metal plate is turned up and bent in a fanfold manner with turned-up end edges alternately formed at a first end and a second end of a rectangular flat face portion, and flat first flow passages and second flow passages are provided alternately in the thickness direction of the metal plate;

a pair of comb-state members, wherein each of the first flow passages of the core body is blocked by a comb tooth of the pair of comb-state members at both end positions of said turned-up end edges;

a fin set within said second flow passages;

a tubular casing having a first end portion and a second end portion, wherein an outer periphery of the core body is fitted with the tubular casing so as to block adjacent turned-up end edges;

an inlet port on an outer face of said casing fluidly connected to the first flow passage;

an outlet port on the outer face of said casing fluidly connected to the first flow passage, wherein a first fluid is guided to each of the first flow passages by the inlet port and guided from each of the first flow passages by the outlet port;

each of the comb-state members being further comprised of a tooth base, the tooth base having a tooth connecting side, a distal side opposing the tooth connecting side in a first direction from the tooth connecting side to a proximal end position of the end positions of the turned up edges, and a tooth base brazing side extending between the tooth connecting side and the distal side along the turned up edges on the first end of the flat face portion, the tooth base brazing side being attached to the turned up edges on the first end of the flat face portion by brazing; and the comb-state members each including comb teeth, each comb tooth of the comb teeth being comprised of a root and an extending portion, the root being connected to and extending from the tooth connecting side of the tooth base in a second direction opposing said first direction then turning back to the first direction and extending in the first direction to the extending portion, the extending portion being connected to the root where the root extends in the first direction at a position offset in the first direction from the tooth connecting side of the tooth base.

2. The heat exchanger according to claim 1, wherein a tip end portion of each comb tooth of one of the comb-state members has a curved portion, the end of the curved portion is formed so as to face the other comb-state member, and said first fluid is guided from the vicinity of said tooth base of the one comb-state member to each of the first flow passages.

3. The heat exchanger according to claim 2, wherein the tip end of said curved portion is turned up and a turned-up tip end portion is formed, and the turned-up tip end portion is brought into contact with and fixed to a respective one of the turned-up end edges of said core body.

4. A heat exchanger comprising:

a core body in which a strip-shaped metal plate is turned up and bent in a fanfold manner with turned-up end edges alternately formed at one end and the other end of a rectangular flat face portion, and flat first flow passages and second flow passages are provided alternately in the thickness direction of the metal plate;

a pair of comb-state members each having comb teeth;

each of the first flow passages of the core body being blocked by a comb tooth of the pair of comb-state members at end positions of said turned-up end edges, and a fin being set within said second flow passages so as to constitute a core;

an outer periphery of the core body being fitted with a tubular casing so as to block adjacent ones of the turned-up end edges;

a tubular casing having an inlet port and an outlet port provided on an outer face of said tubular casing, and first and second tubular openings;

a first fluid being guided to each of the first flow passages by the inlet and outlet ports; and a second fluid being guided from one of the tubular openings of said casing to another of the tubular openings through each of the second flow passages, wherein:

each of said comb-state members has a tooth base that crosses perpendicularly with each of the comb teeth, a root of each of the comb teeth is bent in an L-shape along the tooth base, a plane of the tooth base is in contact with said turned-up end edge, and each connection portion between the comb-state member and the core body is integrally brazed/fixed, and a tip end portion of each of the comb teeth of one of the comb-state members has a curved portion, the end of the curved portion is formed so as to face the other comb-state member, and said first fluid is guided from a vicinity of said tooth base of the one comb-state member to each of the first flow passages, and the tip end of said curved portion is turned up and a turned-up tip end portion is formed, and the turned-up tip end portion is brought into contact with and fixed to a respective one of the turned-up end edges of said core body.

* * * * *